US009840801B2

(12) United States Patent
Kim

(10) Patent No.: US 9,840,801 B2
(45) Date of Patent: Dec. 12, 2017

(54) WASHING MACHINE AND WASHING METHOD THEREOF

(71) Applicant: Dongbu Daewoo Electronics Corporation, Seoul (KR)

(72) Inventor: In Dong Kim, Seoul (KR)

(73) Assignee: Dongbu Daewoo Electronics Corporation, Seoul (KR)

( * ) Notice: Subject to any disclaimer, the term of this patent is extended or adjusted under 35 U.S.C. 154(b) by 419 days.

(21) Appl. No.: 14/553,806

(22) Filed: Nov. 25, 2014

(65) Prior Publication Data

US 2016/0010262 A1 Jan. 14, 2016

(30) Foreign Application Priority Data

Jul. 9, 2014 (KR) ..... 10-2014-0086050

(51) Int. Cl.

| | |
|---|---|
| ***D06F 37/26*** | (2006.01) |
| ***D06F 39/08*** | (2006.01) |
| ***D06F 37/06*** | (2006.01) |

(52) U.S. Cl.

CPC ..... *D06F 37/267* (2013.01); *D06F 37/065* (2013.01); *D06F 39/088* (2013.01)

(58) Field of Classification Search

CPC ..... D06F 37/267; D06F 37/065; D06F 39/088
See application file for complete search history.

(56) References Cited

U.S. PATENT DOCUMENTS

| | | | | |
|---|---|---|---|---|
| 1,111,126 | A * | 9/1914 | Bercaw | D06F 37/04 68/142 |
| 3,715,898 | A * | 2/1973 | Olliges, Sr. | D06F 37/04 68/145 |
| 4,971,449 | A | 11/1990 | Hendren | |
| 5,509,283 | A | 4/1996 | Lee et al. | |
| 6,241,781 | B1 | 6/2001 | Han | |
| 8,336,338 | B2 * | 12/2012 | Cimetta | D06F 37/065 68/142 |
| 2002/0083743 | A1 * | 7/2002 | Uszkureit | D06F 37/065 68/58 |
| 2003/0051514 | A1 * | 3/2003 | Kim | D06F 23/06 68/18 F |
| 2003/0061843 | A1 * | 4/2003 | Ryu | D06F 37/065 68/17 R |

(Continued)

FOREIGN PATENT DOCUMENTS

| | | | |
|---|---|---|---|
| CN | 1227882 | A | 9/1999 |
| CN | 101705598 | B | 8/2011 |

(Continued)

OTHER PUBLICATIONS

Extended European Search Report dated Dec. 4, 2015 issued in corresponding European Patent Application No. 15168172.3.

(Continued)

*Primary Examiner* — Michael Barr
*Assistant Examiner* — Benjamin L Osterhout

(57) ABSTRACT

A washing machine includes an auxiliary washing unit. When an inner tank is rotated during a washing cycle or a rinsing cycle, washing water passing through the auxiliary washing unit impacts the laundry, which lies by trapping on a projection member, thereby improving washing performance.

15 Claims, 6 Drawing Sheets

(56) References Cited

U.S. PATENT DOCUMENTS

| | | | | |
|---|---|---|---|---|
| 2004/0144136 | A1* | 7/2004 | Mae | D06F 33/02 68/12.19 |
| 2005/0034250 | A1* | 2/2005 | Oh | D06F 39/008 8/159 |
| 2005/0097927 | A1* | 5/2005 | Kim | D06F 23/06 68/24 |

FOREIGN PATENT DOCUMENTS

| | | | |
|---|---|---|---|
| EP | 1816250 | | 8/2007 |
| KR | 1019990070288 | A | 9/1999 |
| KR | 20060114121 | | 11/2006 |
| WO | 2011080119 | | 7/2011 |

OTHER PUBLICATIONS

Dong, Jeon Gyu; Remaining Water Circulation System for a Drum Type Washing Machine; Korean Patent Abstracts, Publication No. 20060114121 A; Publication date: Nov. 6, 2006; Korean Intellectual Property Office, http://kpa.kipris.or.kr/.

* cited by examiner

WASHING MACHINE AND WASHING METHOD THEREOF

CROSS-REFERENCE TO RELATED APPLICATION

This application is based on and claims priority to Korean Patent Application No. 2014-0086050, filed on Jul. 9, 2014, the disclosure of which is incorporated herein in its entirety by reference.

TECHNICAL FIELD

Embodiments according to the present invention relate to a washing machine with an auxiliary washing unit, and a washing method using such a washing machine, to improve washing performance.

BACKGROUND

A washing machine uses power from an electric motor as main power, and performs washing, rinsing, and dehydrating (e.g., spin-drying) processes to clean laundry through the action of detergent and water. The washing machine includes the electric motor, a mechanical part for transferring power to the components used to wash the laundry, a controlling part for controlling the washing process, a water supply apparatus, and a water draining apparatus.

Washing machines may be classified into agitator type washing machines, pulsator type washing machines, and drum type washing machines, depending on their washing schemes. An agitator type washing machine performs washing by horizontally rotating a wing-shaped agitator in the center of a washing tub, and the pulsator type washing machine performs washing using waves generated by rotating a disk-shaped pulsator. A drum type washing machine includes a drum having a plurality of protrusions formed thereon. The drum type washing machine performs washing using the impact generated when the laundry is lifted by a lifter in the drum and then dropped into the wash water and detergent contained in the drum as a result of rotating the drum around a horizontal axis.

A washing machine is for washing the laundry as cleanly as possible. For this purpose, efforts to improve washing performance are ongoing.

As a part of the efforts to improve washing performance, the Applicant applied for a patent application for an apparatus for circulating water remaining between the tub and the drum such that the water between the tub and drum is forced to circulate into the drum. Such an apparatus is disclosed in the Korean Patent Laid-Open Publication No, 2006-0114121, laid-open on Nov. 6, 2006, entitled "REMAINING WATER CIRCULATION SYSTEM FOR A DRUM TYPE WASHING MACHINE." Such an apparatus is configured in a way that when the drum is rotated, washing water remaining between the tub and the drum is drawn up and then falls down into the drum.

Such an apparatus was configured so that the impact of the water failing on the laundry would improve washing performance. However, the improvement was limited.

SUMMARY

Embodiments according to the present invention provide a washing machine that includes an auxiliary gashing unit, and a washing method thereof, that improve washing performance by utilizing the speed of flow of the washing water caused by a rotational force generated using an electric motor during a washing cycle and a rinsing cycle, causing the washing water to impact the laundry.

Embodiments according to the present invention provide a washing machine including an outer tank in which washing water can be held, an inner tank which is installed rotatably inside the outer tank, and an auxiliary washing unit which is installed inside the inner tank. The auxiliary washing unit is configured to rotate integrally with the inner tank and has a water channel formed therein that is configured so that the laundry in the inner tank is impacted by the washing water which, after flowing into and through the water channel from the side of the outer tank, flows out of the water channel to the inside of the inner tank due to the rotational force generated when the inner tank is rotated.

In an embodiment, the auxiliary washing unit includes a supporting member in which the water channel is formed, and a projection member which is supported by coupling to the supporting member and that lifts the laundry by trapping; the laundry then dropped while the inner tank is rotated.

The water channel has a shape in which the inner diameter of the outlet positioned inside the inner tank is narrower than that of an inlet positioned in the side of the outer tank, and the inner diameter is narrower toward the inside of the inner tank and away from the side of the outer tank.

In an embodiment, the outlet includes a nozzle that spouts washing water into the inner tank.

The nozzle can be a circular nozzle, a fan-shaped nozzle, or a porous nozzle, for example.

In another embodiment according to the present invention, a washing method includes rotating an inner tank of the washing machine, thus causing washing water to contact an auxiliary washing unit in the side of an outer tank, by rotation of the inner tank; passing the washing water through a water channel in the washing auxiliary unit and then into the inner tank; and washing laundry through contact with the washing water flowing out of the water channel and into the inner tank.

In embodiments according to the present invention, the speed of flow of the washing water caused by the rotational force generated an electric motor, which is a power unit for a washing cycle and a rinsing cycle, causes the washing water to directly impact the laundry, thereby improving washing performance.

DETAILED DESCRIPTION

Hereinafter, embodiments according to the present invention will be described in detail with reference to the accompanying drawings.

In the following description, well-known functions or components will not be described in detail to avoid unnecessarily obscuring aspects of the present invention.

Figure 1:
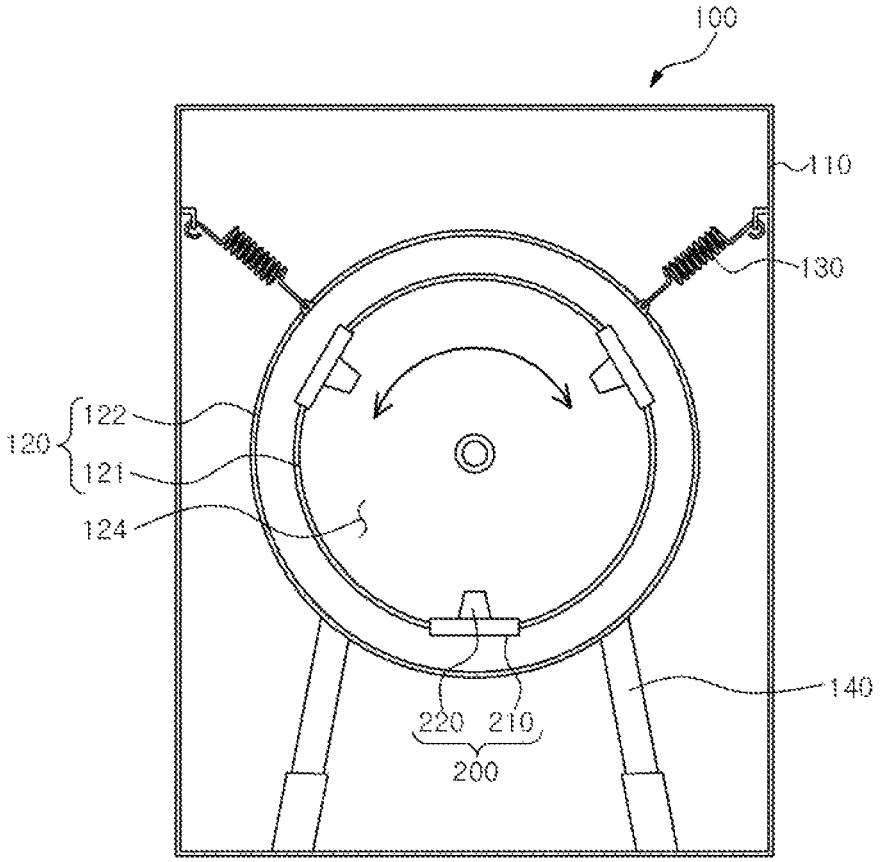
FIG. 1 is a front view of a washing machine in an embodiment according to the present invention.

FIG. 1 is a schematic front view of a washing machine in an embodiment according to the present invention.

Referring to FIG. 1, a washing machine 100 in an embodiment according to the present invention includes a cabinet 110 forming the exterior, a washing body 120 for washing laundry, and an auxiliary washing unit 200 that improves washing performance.

The cabinet 110 is formed in a shape that accommodates and supports the washing body 120. For example, the cabinet 110 may have a hexahedral shape. Also, a control panel (not shown) that includes buttons and the like is provided in the front or upper surface of the cabinet 110 so that a user can select a washing function.

In an embodiment, the washing body 120 is disposed inside the cabinet 110 and includes an inner tank 121 which is installed so that it can be rotated by a motor that has a horizontal rotating shaft. In an embodiment, the washing body 120 includes an outer tank 122 which supports the inner tank 121 and can hold water for washing. If the washing machine 100 is a drum type washing machine, then the inner tank 121 may be referred as a drum, and the outer tank 122 may be referred to as a tub.

As mentioned above, the inner tank 121 can rotate on a shaft that is parallel with the ground (hereinafter, referred to as "the horizontal direction") on which the cabinet 110 is disposed. The inner tank 121 may have a cylindrical shape with an open end which may be opened and closed selectively by a door (not shown). In addition, a washing space 124 in which the laundry can be washed is provided in the inner tank 121.

The upper portion of the outer tank 122, which supports the inner tank 121, may be fixed elastically to the cabinet 110 by an elastic member 130 such as a spring, and the lower portion of the outer tank 122 may be supported by a fixing member 140. The fixing member 140 may be a dampener which can reduce vibration caused by rotation of the inner tank 121.

In an embodiment, the auxiliary washing unit 200 includes a supporting member 210 which rotates integrally with the inner tank 121. Also, in an embodiment, the auxiliary washing unit 200 further includes a projection member 220 which is supported by coupling to the supporting member 210 so that it projects toward the inside of the inner tank 121, and is configured so that laundry in a washing space 124 of the inner tank 121 will be lifted by trapping it with the projection member and then dropped while the inner tank 121 is rotated. In another embodiment, the supporting member 210 is formed high enough so that laundry in the washing space 124 will be lifted by trapping it with the supporting member, in which case the projection member 220 may be excluded from the design.

Figure 2:
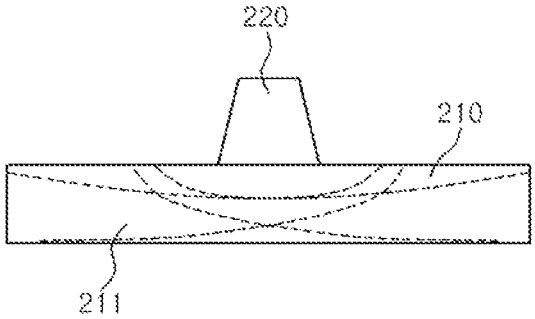
FIG. 2 is a front view of an auxiliary washing unit in a washing machine in an embodiment according to the present invention.
Figure 3:
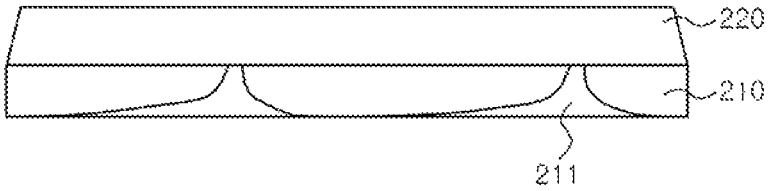
FIG. 3 is a side view of an auxiliary washing unit in a washing machine in an embodiment according to the present invention.
Figure 4:
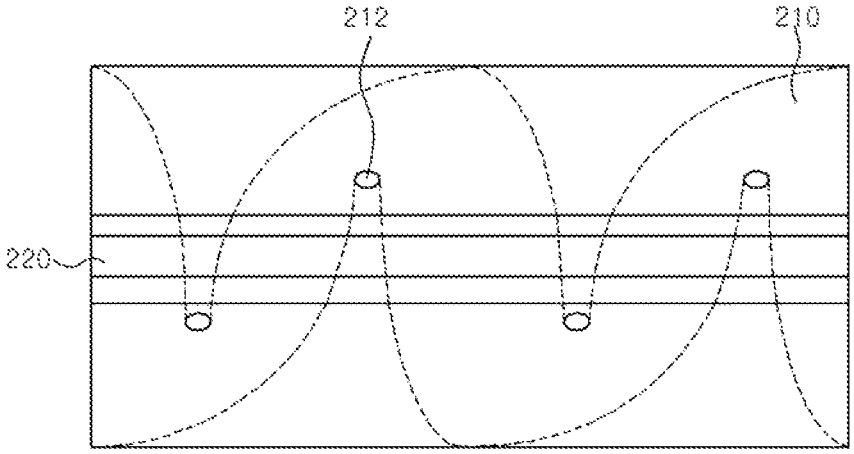
FIG. 4 is a top view of an auxiliary washing unit in a washing machine in an embodiment according to the present invention, which shows an example using a circular nozzle.
Figure 5:
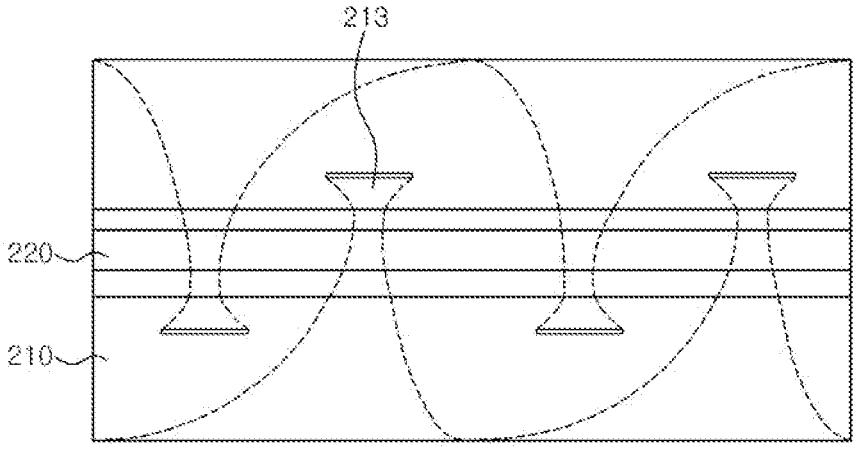
FIG. 5 is a top view of an auxiliary washing unit in a washing machine in an embodiment according to the present invention, which shows an example using a fan-shaped nozzle.
Figure 6:
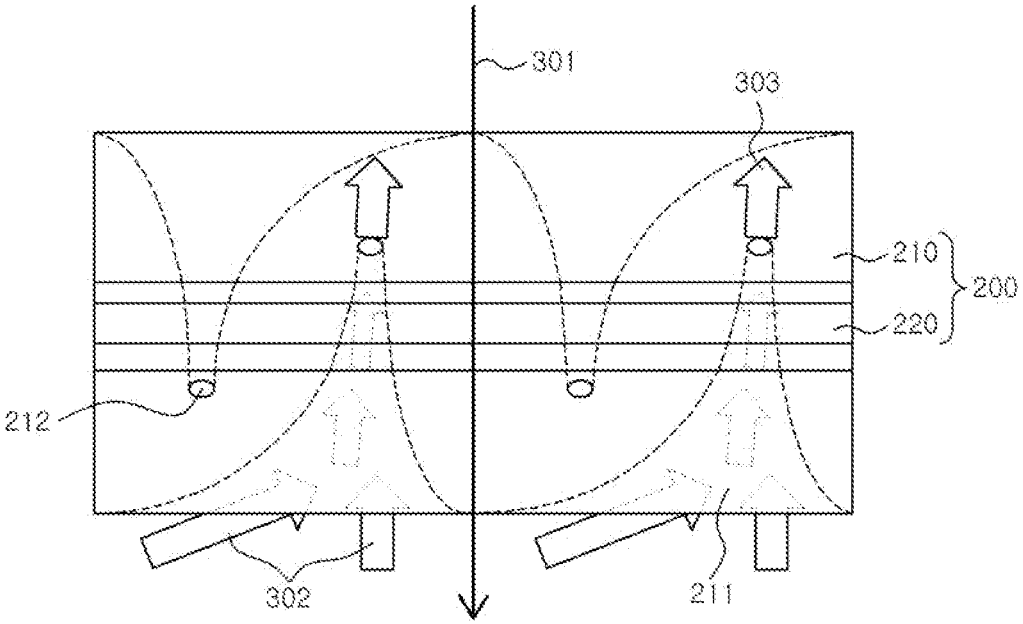
FIG. 6 is a top view of an auxiliary washing unit in a washing machine in an embodiment according to the present invention, which shows an ample using a porous nozzle.

FIG. 2 is a front view of an auxiliary washing unit that can be used in a washing machine in an embodiment according to the present invention. FIG. 3 is a side view of an auxiliary washing unit in a washing machine in an embodiment according to the present invention. FIG. 4 is a top view of an auxiliary washing unit in a washing machine in an embodiment according to the present invention, which shows an example using a circular nozzle. FIG. 5 is a top view of an auxiliary washing unit in a washing machine in an embodiment according to the present invention, which shows an example using a fan-shaped nozzle. FIG. 6 is a top view of an auxiliary washing unit in a washing machine in an embodiment according to the present invention, which shows an example using a porous nozzle.

Referring to FIGS. 2 through 6, a water channel 211 is formed in the supporting member 210 of the washing auxiliary unit 200 in an embodiment according to the present invention. The water channel 211, which is configured so that laundry trapped by the projection member 220 will be impacted by washing water which, after flowing in from the side of the outer tank, flows out to the inside of the inner tank due to the rotational force being generated when the inner tank is rotated. As shown in FIGS. 4 through 6, the water channel 211 is formed inside of the supporting member 210, and is shown as a dotted line.

In an embodiment, the water channel 211 has a shape such that the inner diameter of the outlet positioned inside of the inner tank 121 is narrower than that of the inlet positioned in the side of the outer tank 122, and also the inner diameter is narrower toward the inside of the inner tank 121 and away from the side of the outer tank 122. Further, around the outlet of the inside of the inner tank 121, a nozzle which directs washing water toward the inside of the inner tank 121 is formed. The nozzle may be any one of various shapes, such as but not limited to a circular nozzle or a fan-shaped nozzle 213.

Also, as the inner tank 121 is repeatedly rotated forward and in reverse during a washing cycle and a rinsing cycle, washing water in the supporting member 210 moves in the forward direction, in which the washing water moves forward after flowing in while the inner tank 121 is rotated in the forward direction, and in the reverse direction, in which the washing water moves in reverse after flowing in while the inner tank 121 is rotated in the reverse direction.

Figure 9:
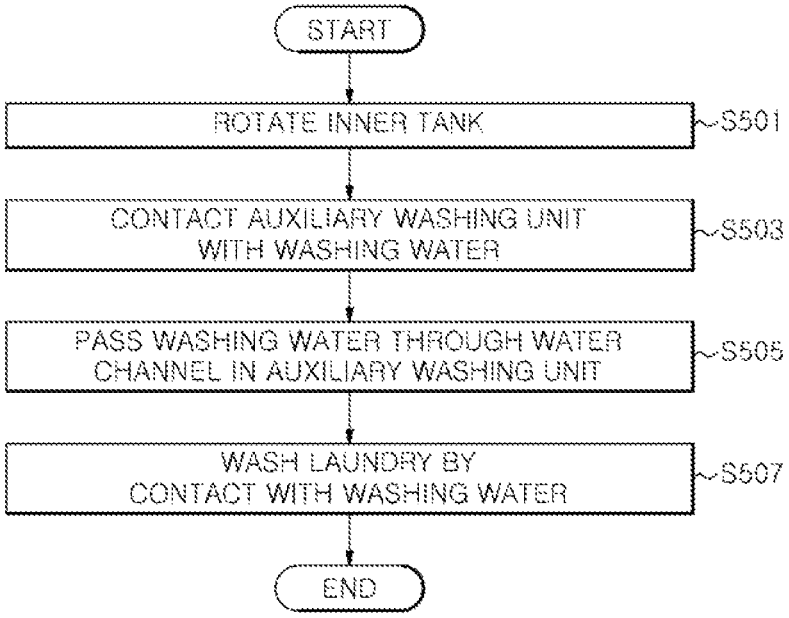
FIG. 9 is a flowchart illustrating a washing method using a washing machine with an auxiliary washing unit in an embodiment according to the present invention.

FIG. 9 is a flowchart illustrating a washing method using a washing machine with an auxiliary washing unit in an embodiment according to the present invention.

As described in FIG. 9, the washing method in an embodiment according to the present invention includes rotating the inner tank (block S501).

The washing method further includes the washing water in the side of the outer tank getting in contact with the auxiliary washing unit while the inner tank is rotating (block S503).

Next, the washing method further includes the washing water passing through the water channel formed in the auxiliary washing unit and flowing out to the inside of the inner tank (block S505).

Finally, the washing method further includes washing the laundry by contacting the laundry with the washing water that flows out of the water channel to the inside of the inner tank as mentioned above (block S507).

Hereinafter, operation of a washing machine according to an aspect of the present invention will be described.

First, during a washing cycle or a rinsing cycle, washing water is held in the outer tank 122, and the inner tank 121 is rotated by a motor that has a rotational shaft that is disposed horizontally to the ground, at block S501.

In an embodiment, laundry in the washing space 124 is lifted and dropped repeatedly by the projection member 220 of the auxiliary washing unit 200 while the inner tank 121 is rotated. That is, the projection member 220 performs a function similar to a lifter in a drum type washing machine. In another embodiment, laundry is lifted and dropped repeatedly by the supporting member 210 in lieu of the projection member 220 as described above.

When the inner tank 121 is rotated as described above, the auxiliary washing unit 200 is contacted by the washing water in the outer tank 122, at block S503, and the washing water in the outer tank 122 flows into the water channel 211 in the supporting member 210 of the auxiliary washing unit 200 due to the rotational force of the inner tank 121, and then passes through then out of the water channel to the inside of the inner tank 121, at block S505. That is, washing water spouts from the circular nozzle 212, the fan-shaped nozzle 213, or the porous nozzle 214 positioned in the inner tank 121. Accordingly, the laundry trapped by the projection member 220 is contacted by the washing water and is impacted by the flow of the washing water, and is thereby washed, at block S507. For example, the circular nozzle 212 can direct an impact intensely to a specific part of the laundry, and the fan-shaped nozzle 213 can direct an impact to larger area of the laundry.

Because, in an embodiment, the water channel 211 has a shape such that the inner diameter of the outlet positioned in the inside of the inner tank 121 is narrower than that of the inlet positioned in the side of the outer tank 122, the speed of the washing water passing through the water channel 211 is increased as the water flows toward the outlet from the inlet, and increases further while passing through the circular nozzle 212 or the fan-shaped nozzle 213, thereby providing sufficient impact to the laundry trapped by the projection member 220.

For example, as shown in FIG. 6, when the auxiliary washing unit 200 proceeds in the direction of the arrow 301 due to rotation of the inner tank 121, the washing water flows into and through the water channel 211 in the supporting member 210 in the direction of the arrow 302 and spouts out of the water channel in the direction of the arrow 303 via the circular nozzle 212. As shown in FIG. 6, for example, the water channel 211 is formed in the supporting member 210, which is shown using dotted lines.

Figure 7:
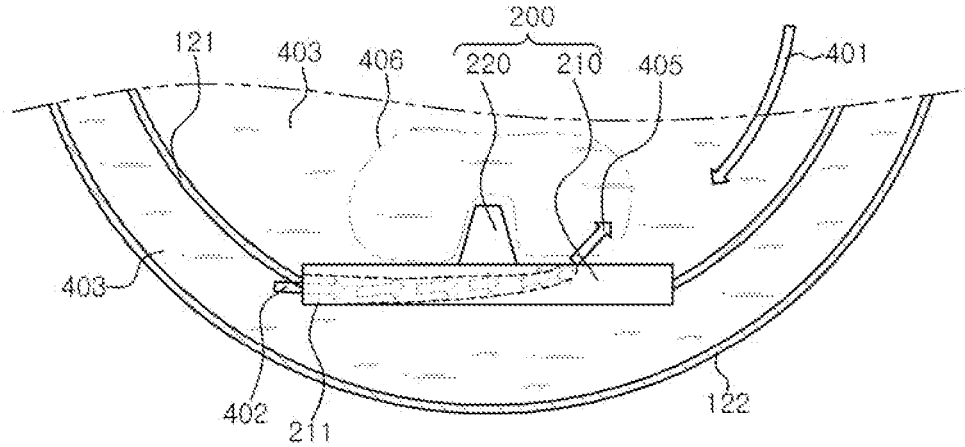
FIG. 7 is a top view of an auxiliary washing unit in a washing machine in an embodiment according to the present invention, which shows a path that washing water stored in an outer tank takes into a water channel and then toward the inside of the inner tank.
Figure 8:
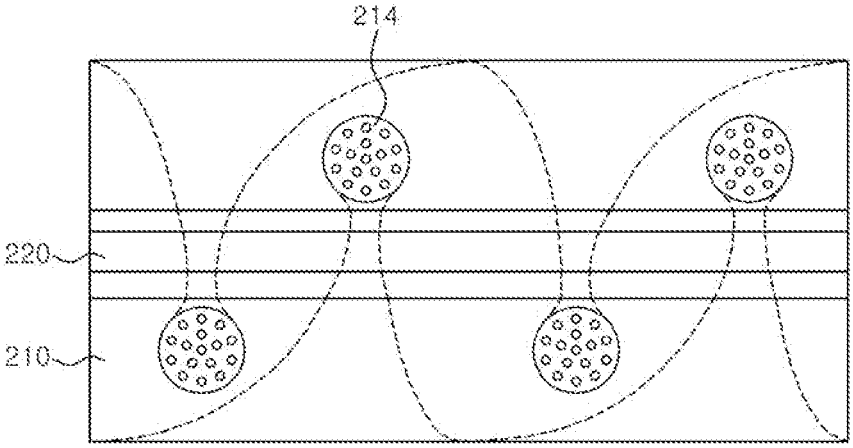
FIG. 8 is a front view of a washing machine with an auxiliary washing unit in an embodiment according to the present invention, which shows a path that washing water stored in an outer tank takes into a water channel of the auxiliary washing unit and then toward the inside of the inner tank.

Further, as shown in FIG. 7, when the inner tank 121 is rotated in the direction of the arrow 401, the washing water 403 flows into and through the water channel 211 in the supporting member 210 in the direction of the arrow 402 and spouts out of the water channel and into the inner tank 121 in the direction of the arrow 405. Consequently, laundry 406 that is trapped on the projection member 220 is subject to an impact caused by the speed of flow of the washing water 403 out of the water channel/nozzle.

Thus, as described above, in an embodiment according to the present invention, when the inner tank 121 is rotated during the washing cycle or the rinsing cycle, washing water passing through the auxiliary washing unit 200 impacts the laundry which is trapped on the projection member 220, thereby improving washing performance.

As set forth above, while the present invention has been described in connection with specific embodiments of a washing machine, is the embodiments are only examples and the present invention is not limited thereto. It should be construed that the present invention has the widest range in compliance with the basic ideas disclosed in this disclosure. Although it is possible for those skilled in the art to combine and substitute for the disclosed embodiments to embody other wash machine types that may not be specifically disclosed in this disclosure, they do not depart from the spirit and scope of the present invention. In addition, it will be apparent to those skilled in the art that various modifications and changes may be made with respect to the disclosed embodiments based on this disclosure and those changes and modifications also fall within the spirit and scope of the present invention.

Embodiments according to the invention are thus described. While the present disclosure has been described in particular embodiments, it should be appreciated that the invention should not be construed as limited by such embodiments, but rather construed according to the below claims.

What is claimed is:

1. A washing machine, comprising:

an outer tank in which washing water can be held;

an inner tank which is installed rotatably inside the outer tank; and an auxiliary washing unit which is installed inside the inner tank;

wherein the auxiliary washing unit is configured to rotate integrally with the inner tank, and has a water channel formed therein that is configured so that laundry in the inner tank receives an impact from the washing water which, after flowing into the water channel from the side of the outer tank, flows out of the water channel to the inside of the inner tank by a rotational force generated when the inner tank is rotated;

wherein the auxiliary washing unit includes:

a supporting member in which the water channel is formed; and a projection member which is coupled to and supported by the supporting member and which lifts the laundry by trapping while the inner tank is rotated, wherein an inlet of the water channel is formed in the supporting member and the inlet is opened in a tangential direction of the inner tank, and an outlet of the water channel is formed in the supporting member.

2. The washing machine of claim 1, wherein the water channel has a shape in which an inner diameter of the outlet positioned in the inside of the inner tank is narrower than that of the inlet positioned in the side of the outer tank, and the inner diameter is narrower toward the inside of the inner tank and away from the side of the outer tank.

3. The washing machine of claim 2, wherein the outlet comprises a nozzle which spouts the washing water into the inner tank.

4. The washing machine of claim 3, wherein the nozzle is selected from the group consisting of: a circular nozzle, a fan-shaped nozzle, and a porous nozzle.

5. The washing machine of claim 2, wherein the outlet comprises a nozzle which spouts the washing water onto the laundry trapped by the projection member.

6. A washing method, comprising:

rotating an inner tank of a washing machine, wherein the rotation of the inner tank causes water to contact an auxiliary washing unit in the side of an outer tank; and passing the water into and through a water channel formed in the auxiliary washing unit and then out from the auxiliary washing unit into the inner tank;

wherein laundry is washed by the laundry contacting the washing water flowing out of the water channel;

wherein the auxiliary washing unit includes:

a supporting member in which the water channel is formed; and a projection member which is coupled to and supported by the supporting member and which lifts the laundry by trapping while the inner tank is rotated, wherein an inlet of the water channel is formed in the supporting member and the inlet is opened in a tangential direction of the inner tank, and an outlet of the water channel is formed in the supporting member.

7. The washing method of claim 6, wherein the water channel has a shape in which an inner diameter of the outlet positioned in the inside of the inner tank is narrower than that of the inlet positioned in the side of the outer tank, and the inner diameter is narrower toward the inside of the inner tank and away from the side of the outer tank.

8. The washing method of claim 7, wherein the outlet comprises a nozzle which spouts the washing water into the inner tank.

9. The washing method of claim 8, wherein the nozzle is selected from the group consisting of: a circular nozzle, a fan-shaped nozzle, and a porous nozzle.

10. The washing method of claim 7, wherein the outlet comprises a nozzle which spouts the washing water onto the laundry trapped by the projection member.

11. An auxiliary washing unit installed in an inner tank of a washing machine, the auxiliary washing unit comprising:

a supporting member coupled to the inner tank that rotates integrally with the inner tank;

a water channel formed in the supporting member and that is configured so that laundry in the inner tank receives an impact from washing water which, after flowing into the water channel from an outer tank, flows out of the water channel to the inside of the inner tank by a rotational force generated when the inner tank is rotated; and a projection member which is supported by coupling to the supporting member and that lifts the laundry by trapping while the inner tank is rotated, wherein an inlet of the water channel is formed in the supporting member and the inlet is opened in a tangential direction of the inner tank, and an outlet of the water channel is formed in the supporting member.

12. The auxiliary washing unit of claim 11, wherein the water channel has a shape in which an inner diameter of the outlet positioned in the inside of the inner tank is narrower than that of the inlet positioned in the side of the outer tank, and the inner diameter is narrower toward the inside of the inner tank and away from the side of the outer tank.

13. The auxiliary washing unit of claim 12, wherein the outlet comprises a nozzle which spouts the washing water into the inner tank.

14. The auxiliary washing unit of claim 13, wherein the nozzle is selected from the group consisting of: a circular nozzle, a fan-shaped nozzle, and a porous nozzle.

15. The auxiliary washing unit of claim 12, wherein the outlet comprises a nozzle which spouts the washing water onto the laundry trapped by the projection member.

* * * * *